US008093971B2

(12) United States Patent
Wang et al.

(10) Patent No.: US 8,093,971 B2
(45) Date of Patent: Jan. 10, 2012

(54) MICRO-ELECTROMECHANICAL SYSTEM SWITCH

(75) Inventors: Xuefeng Wang, Schenectady, NY (US); Alex David Corwin, Niskayuna, NY (US); Bo Li, Clifton Park, NY (US); Kanakasabapathi Subramanian, Clifton Park, NY (US); Kuna Venkat Satya Rama Kishore, Bangalore, IN (US)

(73) Assignee: General Electric Company, Niskayuna, NY (US)

( * ) Notice: Subject to any disclaimer, the term of this patent is extended or adjusted under 35 U.S.C. 154(b) by 221 days.

(21) Appl. No.: 12/340,775

(22) Filed: Dec. 22, 2008

(65) Prior Publication Data

US 2010/0155203 A1 Jun. 24, 2010

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,160,230 | A | 12/2000 | McMillan et al. | |
| 6,891,454 | B1 * | 5/2005 | Naito et al. | 335/78 |
| 7,432,788 | B2 * | 10/2008 | Glukh et al. | 335/78 |
| 7,453,339 | B2 * | 11/2008 | Fork et al. | 335/78 |
| 7,602,267 | B1 * | 10/2009 | Niblock et al. | 335/78 |
| 7,619,497 | B2 * | 11/2009 | Yuba et al. | 335/78 |
| 2002/0000364 | A1 * | 1/2002 | Hong et al. | 200/181 |
| 2003/0006858 | A1 | 1/2003 | Ma | |
| 2003/0122640 | A1 | 7/2003 | Deligianni et al. | |
| 2004/0211654 | A1 | 10/2004 | Park | |
| 2008/0169707 | A1 | 7/2008 | Wright et al. | |

FOREIGN PATENT DOCUMENTS

| | | | |
|---|---|---|---|
| WO | 9963562 | A1 | 12/1999 |
| WO | W02007130913 | A2 | 11/2007 |

OTHER PUBLICATIONS

EP09178257 Search Report, July 8, 2010.

* cited by examiner

*Primary Examiner* — Bernard Rojas
(74) *Attorney, Agent, or Firm* — Richard D. Emery

(57) ABSTRACT

A micro electromechanical system switch having an electrical pathway is presented. The switch includes a first portion and a second portion. The second portion is offset to a zero overlap position with respect to the first portion when the switch is in open position (or in the closed position depending on the switch architecture). The switch further includes an actuator for moving the first portion and the second portion into contact.

20 Claims, 7 Drawing Sheets

MICRO-ELECTROMECHANICAL SYSTEM SWITCH

BACKGROUND

The invention relates generally to a switch and in particular, to a micro-electromechanical system switch.

The use of micro-electromechanical system (MEMS) switches has been found to be advantageous over traditional solid-state switches. For example, MEMS switches have been found to have superior power efficiency, low insertion loss, and excellent electrical isolation.

MEMS switches are devices that use mechanical movement to achieve a short circuit (make) or an open circuit (break) in a circuit. The force required for the mechanical movement can be obtained using various types of actuation mechanisms such as electrostatic, magnetic, piezoelectric, or thermal actuation. Electrostatically actuated switches have been demonstrated to have high reliability and wafer scale manufacturing techniques. Construction and design of such MEMS switches have been constantly improving.

Switch characteristics such as standoff voltage (between the contacts of the switch) and pull-in voltage (between the actuator and the contact) are considered for design of MEMS switches. Typically, while trying to achieve higher stand-off voltage presents a contradicting characteristic of a decreased pull-in voltage. Traditionally, increasing beam thickness and gap size increases stand-off voltage. However, this increases the pull-in voltage as well and that is not desirable.

There exists a need for an improved MEMS switch that exhibits substantially high standoff voltage and at the same time substantially lower pull-in voltage without additional complexity in the switch design.

BRIEF DESCRIPTION

Briefly, a micro electromechanical system switch having an electrical pathway is presented. The switch includes a first portion and a second portion. The second portion is offset to a zero overlap position with respect to the first portion when the switch is in open position (or in the closed position depending on the switch architecture). The switch further includes an actuator for moving the first portion and the second portion into contact.

In one embodiment, an apparatus to make or break an electrical connection is presented. The apparatus includes an actuator and a cantilever beam to carry a current. The apparatus further includes a terminal to carry the current, wherein the terminal is disposed at a zero overlap position with respect to the cantilever beam.

In one embodiment, a micro electromechanical system switch having an electrical pathway is presented. The switch includes a first portion and a second portion, wherein the second portion is offset to a zero overlap position with respect to the first portion. The switch further includes an actuator for moving the first portion and the second portion into contact upon actuation or de-couple upon de-actuation.

In one embodiment, a switch having an electrical pathway is presented. The switch includes a first portion and a second portion, wherein the second portion is offset to a zero overlap position with respect to the first portion. The second portion is disposed in-plane with respect to the first plane. An actuator for moving the first portion and the second portion into contact is provided.

In one embodiment, a switch having an electrical pathway is presented. The switch includes a first beam and a second beam, wherein the second beam is offset to a zero overlap position with respect to the first beam. The first beam is suspended from an upper substrate. An actuator for moving the first beam and the second beam to make a contact is provided. In addition, a second or a third actuator is provided to actively open the first or the second beam of the switch.

In one embodiment, more than one pair of the in-plane and out-of-plane moving portions can be arranged around the same actuator to form a switch.

In one embodiment, a method of fabricating a micro-electromechanical switch is presented. The method includes providing a base substrate with an electrically insulating first surface, providing an electrically conductive or semiconductive top substrate with a secondary surface formed onto the first surface of the base substrate. The method further includes attaching the second surface of the top substrate to the first surface of the base substrate, etching the top substrate to define an electrode, coating the top substrate with a insulating layer, and forming a single or composite cantilever beam on the top substrate with a zero overlap area between the cantilever beam and the electrode. The top and the base substrates can be attached together using semiconductor wafer bonding techniques or a silicon on insulator (SOI) wafer can be used instead of two bonded substrates. In yet another embodiment, one cantilever beam can be formed on a third substrate and attached to the top substrate with the desired gap between the cantilever beam and the top substrate through wafer bonding or other techniques.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

A MEMS switch can control electrical, mechanical, or optical signal flow. MEMS switches typically provide lower losses, and higher isolation. Furthermore MEMS switches provide significant size reductions, lower power consumption and cost advantages as compared to solid-state switches. MEMS switches also provide advantages such as broadband operation (can operate over a wide frequency range). Such attributes of MEMS switches significantly increase the power handling capabilities. With low loss, low distortion and low power consumption, the MEMS switches may be suited for applications such as telecom applications, analog switching circuitry, and switching power supplies. MEMS switches are also ideally suited for applications where high performance electro-mechanical, reed relay and other single function switching technologies are currently employed.

MEMS switches may employ one or more actuation mechanisms, such as electrostatic, magnetic, piezoelectric, or thermal actuation. Compared to other actuation methods, electrostatic actuation provides fast actuation speed and moderate force. Electrostatic actuation requires ultra low power because typically power of the order of nano-joules are required for each switching event and no power is consumed when the switch is in the closed or open state. This approach is far better suited to power sensitive applications than the more power hungry magnetic switch activation approach that is traditionally used by mechanical relays in such applications. For example, conventional relays operate with high mechanical forces (contact and return) for short lifetimes (typically around one million cycles). MEMS switches operate with much lower forces for much longer lifetimes. Benefits of low contact forces are increased contact life. However, lower contact forces qualitatively change contact behavior, especially increasing sensitivity to surface morphology and contaminants and the corresponding low return forces make the switches susceptible to sticking.

Figure 1:
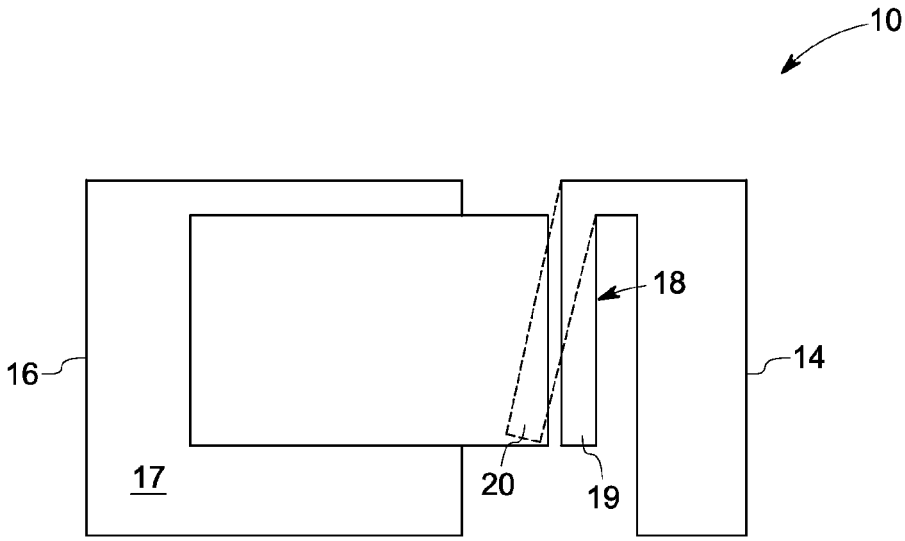
FIG. 1 is a top view of a micro-electromechanical system (MEMS) switch implemented according to an aspect of the present technique

Turning now to FIG. 1, top view of a MEMS switch implemented according to an aspect of the present technique. The MEMS switch 10 includes an electrical pathway having a first portion 12 and a second portion 18. The first portion 12 (a cantilever beam) is disposed on an actuator 16. An insulation layer 17 is disposed between the actuator 16 and the cantilever beam 12. The second portion 18 (a second beam or a terminal) is disposed on a top substrate 14. The second beam 18 is disposed in an offset position with respect to the cantilever beam 12 such that a zero overlap position is formed. The actuator 16 is configured to provide an electrostatic force for moving the cantilever beam 12 and the second beam 18 in to contact during operation of the switch 10. In an exemplary embodiment, the second beam 18 is resting in position 19 while the switch 10 is in "open" state and moves to position 20 up on actuation while the switch 10 is in "closed" state.

Figure 2:
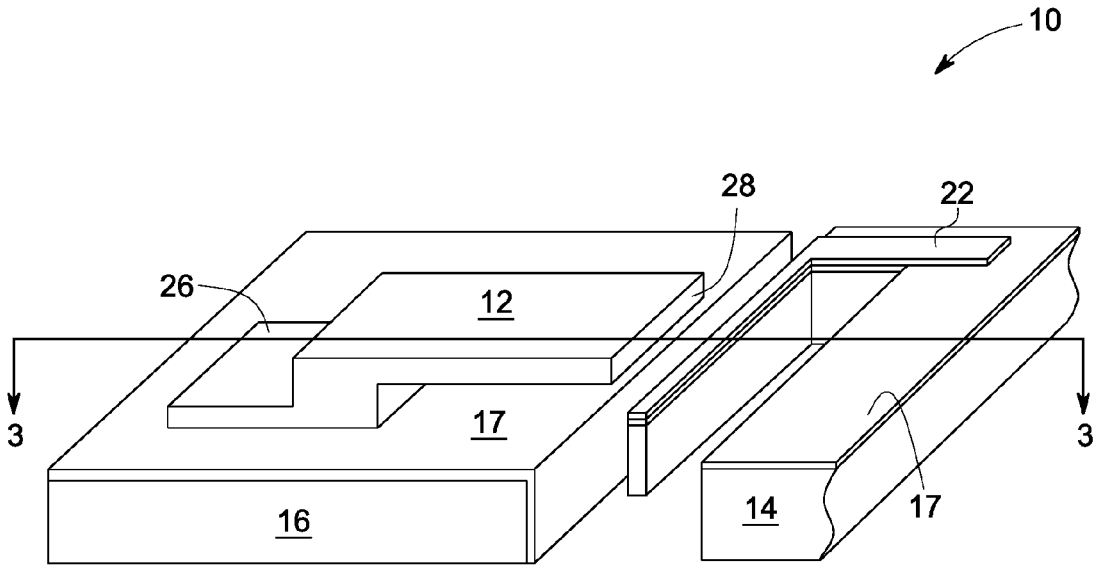
FIG. 2 is a partial perspective view of MEMS switch in FIG. 1.

FIG. 2 is a partial perspective view of the MEMS switch of FIG. 1 as indicated by the reference numeral 10. The first portion 12 also referenced as cantilever beam is disposed above the actuator 16. The cantilever beam 12 includes a base 26 disposed on the insulating layer 17 and a freestanding tip 28. The freestanding tip 28 of the cantilever beam 12 is suspended above the second beam 18 (terminal). The second beam 18 includes a conducting layer 22 disposed on its surface that come in contact with the cantilever beam 12. The substrate hosts numerous electronics such as drive circuitry and protection circuitry required to render the MEMS switch 10 operational. The cantilever beam 12 and the terminal 18 may also be referred as an electrode pair. One of the challenges MEMS switch designers face is unwanted contact of the electrode pair. The electrodes of a MEMS switch are ideally positioned very close together while in an "open" position. By placing the electrodes closely together, the power required (or the pull-in voltage) to deflect the beam to the "closed" position is reduced. However, an unwanted contact of the electrodes can result from this design. Ideally, the MEMS switch requires voltage between the actuator 16 and the electrode pair 12, 18 (standoff voltage) to be high and the pull-in voltage to be low. To achieve higher standoff voltage the electrodes have to be placed further away from one another and this would result in a higher pull-in voltage. To achieve high turnoff ratio and a low pull in voltage is contradictory as discussed above. A turnoff ratio is defined as the ratio of standoff voltage to pull-in voltage. However, embodiments of the invention are cleverly articulated to increase the turnoff ratio.

Figure 3:
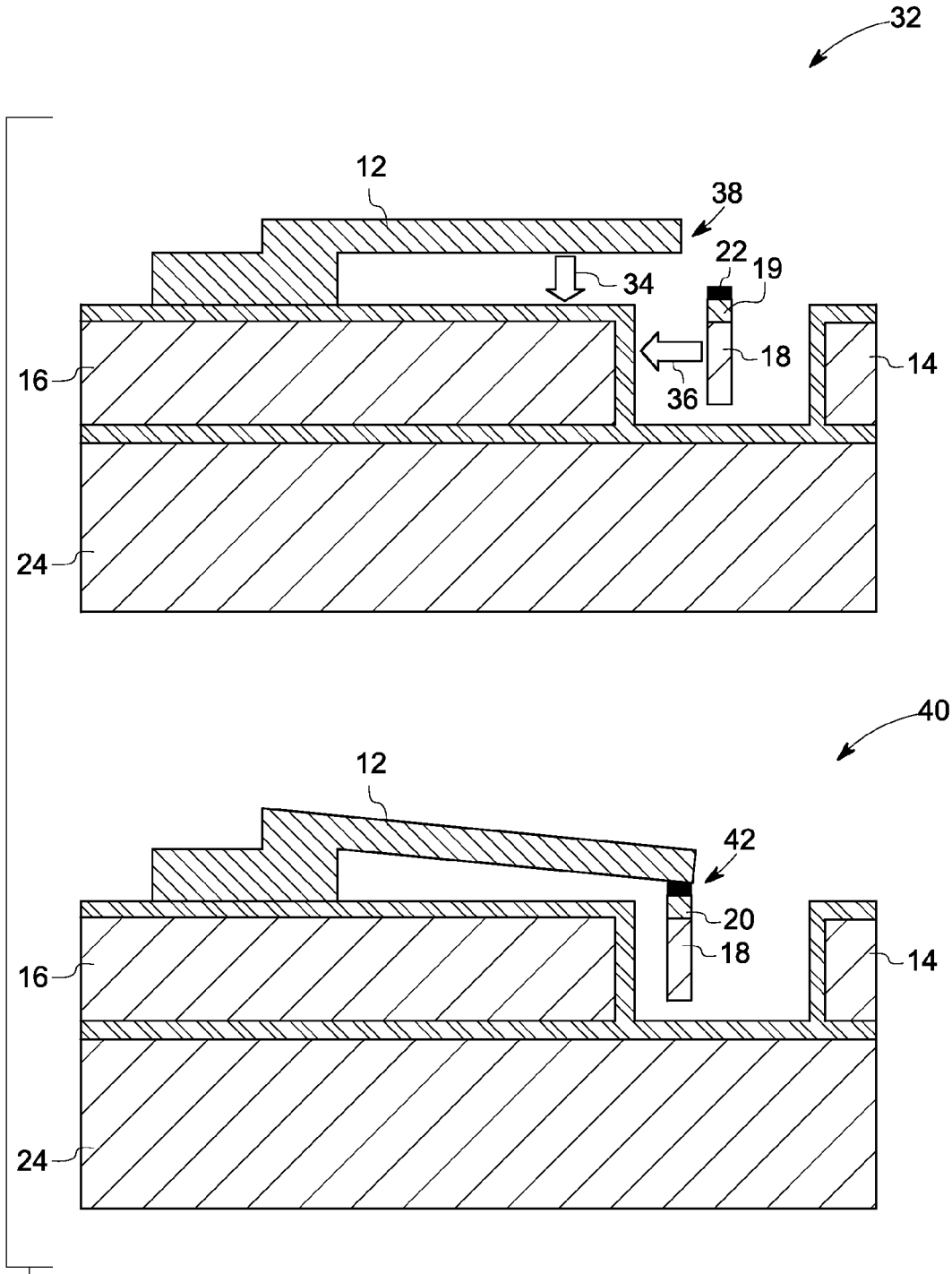
FIG. 3 is a cross sectional view of the MEMS switch in FIG. 2.

FIG. 3 is a cross sectional view of the MEMS switch of FIG. 2. The MEMS switch in "open" position (an operation state) is generally indicated by the reference numeral 32. The cantilever beam 12 is free to move (flex) in an out-of-plane direction 34 with respect to the actuator 16. For example, the cantilever beam 12 moves from position 38 while in "open" position to 42 while in "closed" position. Similarly the second beam 18 is configured to flex in an in-plane direction 36 with respect to the actuator 16. When the MEMS switch is in "open" condition, the cantilever beam is at rest position 19 and similarly, the second beam 18 is at first position 19. During an operation, the MEMS switch in "closed" position is illustrated by the reference numeral 40, a voltage is applied to the actuator 16, a resultant electrostatic force pulls the second beam 18 to a position 20 toward the actuator 16. Similarly, the voltage from the actuator 16 relative to the cantilever beam 12 generates a resultant electrostatic force that pulls the cantilever beam 12 to a position 42 towards the actuator 16. At that point, the switch is closed and an electrical pathway is formed through the cantilever beam 12 and the second beam 18. As the actuation is electrostatic, no quiescent current is required to maintain closure.

In one embodiment of the invention, the cantilever beam 12 and the second beam 18 are designed to have slightly different mechanical characteristics. Different mechanical characteristics such as stiffness help in achieving varying speeds of motion for the cantilever beam 12 and the second beam 18 during an operation of the MEMS switch. During closing, the second beam 18 moves faster relative to the cantilever beam 12, resulting in cantilever beam 12 closing on top of the second beam 18. During opening, cantilever beam 12 moves relative to the second beam 18 to break contact. The proposed operation sequence may be achieved by using a stiffer cantilever beam 12 relative to the second beam 18. The material selection, and geometric dimensions (length, width, thickness) of the cantilever beam 12 and the second beam 18 may determine the mechanical characteristics. In an exemplary embodiment, varying actuating voltages may be applied to achieve operating sequence of closing the cantilever beam 12 and the second beam 18. For example, a multi level stepped voltage may be applied to the actuator 16 that includes a first step voltage and a second step voltage. The cantilever beam 12 may be configured to a first pull-in voltage and the second beam configured to a second pull-in voltage which may be lesser than the first pull-in voltage. Initially, the first step voltage may be applied to the actuator 16, wherein the first step voltage is greater than the second pull-in voltage and less than the first pull-in voltage, actuating the second beam 18 to close. Later, the second step voltage may be applied to the actuator 16, wherein the second step voltage is greater than the first pull-in voltage, actuating the cantilever beam 12 to move and make contact with the second beam 18.

In an exemplary embodiment the top substrate 14 may be configured to form a second actuator for the second beam 18. During opening of the MEMS switch, the second actuator 14 may be activated to provide electrostatic force to the second beam 18, to pull the second beam 18 away from the cantilever beam 12.

Figure 4:
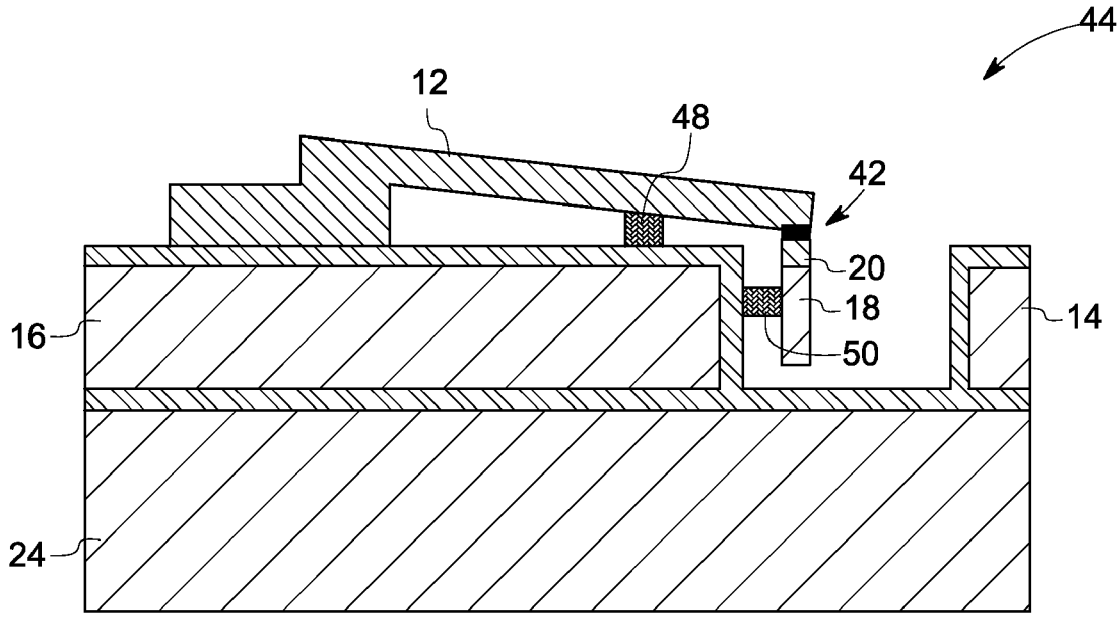
FIG. 4 is a another embodiment of the MEMS switch of FIG. 1.

A further embodiment of the MEMS switch is illustrated in FIG. 4 (reference numeral 44). At a "closed" position of the MEMS switch, the cantilever beam 12 may be configured to rest on a first mechanical stop bump 48 and similarly the second beam 18 may be configure to rest on second mechanical stop bump 50. In an exemplary embodiment, the stop bumps are made of at least one of insulating material, semiconductive material, or conductive material. As may be appreciated by one skilled in the art, providing such mechanical stop bumps 48, and 50 may avoid accidental and undesired short circuits from occurring between the cantilever beam and the actuator.

Figure 5:
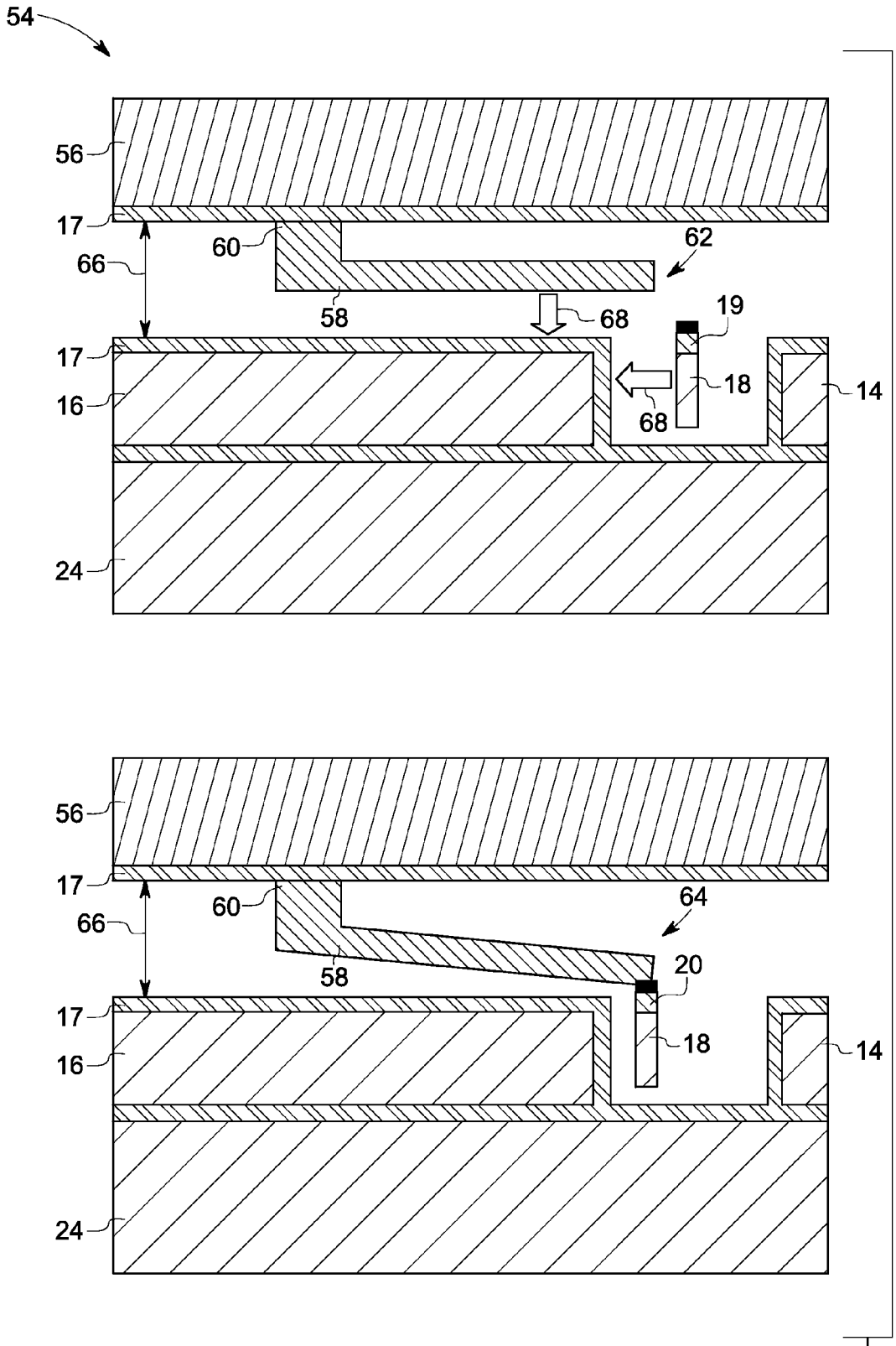
FIG. 5 is a cross sectional view of an exemplary MEMS switch according to an aspect of the present technique.

FIG. 5 is a cross sectional view of an exemplary MEMS switch according to an aspect of the present technique. The switch 54 is configured to provide an electrical pathway having a first beam 58 and a second beam 18. The second beam 18 is offset to a zero overlap position with respect to the first beam 58. The first beam 58 has a fixed end 60 suspended from an upper substrate 56. The upper substrate 56 is disposed with a pre-defined gap 66 to maintain isolation between the first beam 58 and the actuator 16 while the MEMS switch is in an open position 62. Further, an insulation layer 17 is disposed between the upper substrate and the first beam.

During an operation of the MEMS switch 54, voltage is applied to bias the actuator 16. The biasing provides an electrostatic force 68. The cantilever beam 58 actuates in an out-of-plane direction from position 62 to position 64 due to the resulting electrostatic force. Similarly, the second beam 18 actuates in an in-plane direction from position 19 to position 20. While in the "closed" state, the cantilever beam 58 in position 64 and the second beam 18 in position 20 forms an electrical pathway. As discussed earlier the sequence of actuation is achieved by different mechanical characteristics of the beam or multi level step voltage actuation.

Figure 6:
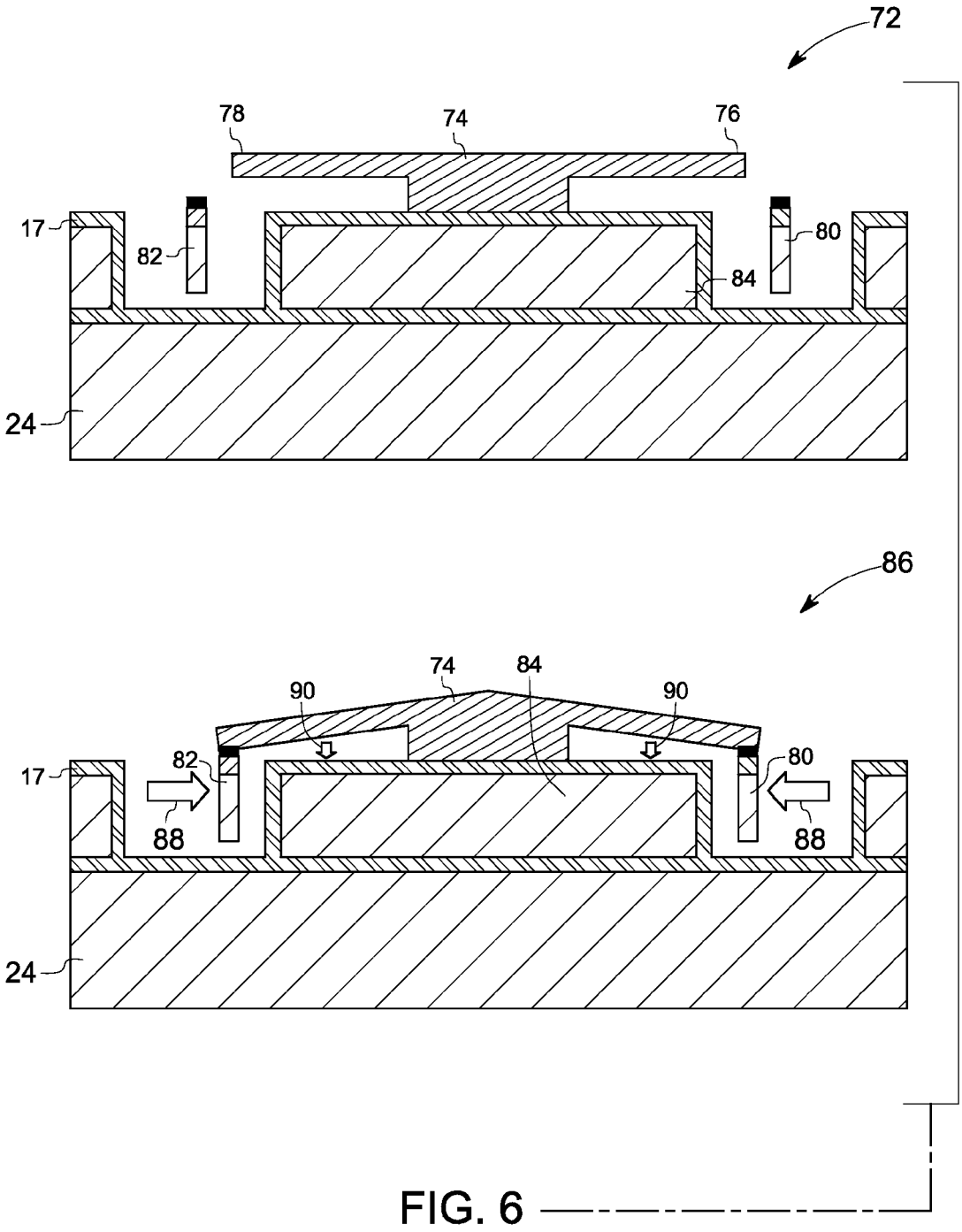
FIG. 6 is a cross sectional view of a MEMS switch implementing a three beam construction according to an aspect of the present technique.

FIG. 6 is a cross sectional view of a MEMS switch implementing a three beam construction according to an aspect of the present technique. The MEMS switch 72 includes a base substrate 24 having an insulating layer 17. A top substrate 84 is disposed on the insulating layer 17. A first beam 74 having at least two free moving ends 76, 78 is anchored on the top substrate 84. An insulating layer 85 electrically isolates the top substrate 84 and the first beam 74. The top substrate further defines a second beam 80 and a third beam 82 disposed out of plane with respect to the free moving ends 76, 78 of the first beam 74. Such out of plane disposition provides a zero overlap position between the second beam 80 and the free moving end 76 of the first beam 74. Similarly, there is a zero overlap position between the third beam 82 and the free moving end 78 of the first beam 74.

During an operation, the MEMS switch, illustrated by the reference numeral 86, is in a "closed" position. The top substrate 84 is configured to form an actuator 84. Upon providing a voltage to the actuator 84 (actuation), an electrostatic force is generated to provide motion to the free moving ends 76, 78 of the first beam 74, the second beam 80, and the third beam 82. It may be noted that the free moving ends 76, 78 actuate in an out-of-plane direction (90) and the second beam 80, the third beam 82 actuate in an in-plane direction (88). The actuator 84 produces an electrostatic force 88, 90. The electrostatic force 88 provides a force of attraction for the second beam 80 and the third beam 82 for in-plane actuation. Similarly, the electrostatic force 90 provides the force of attraction for the free moving ends 76, 78 for out-of-plane actuation. In this "closed" state (operating state of the MEMS switch,) an electrical pathway is formed between the first beam 74, the second beam 80, and the third beam 82.

Figure 7:
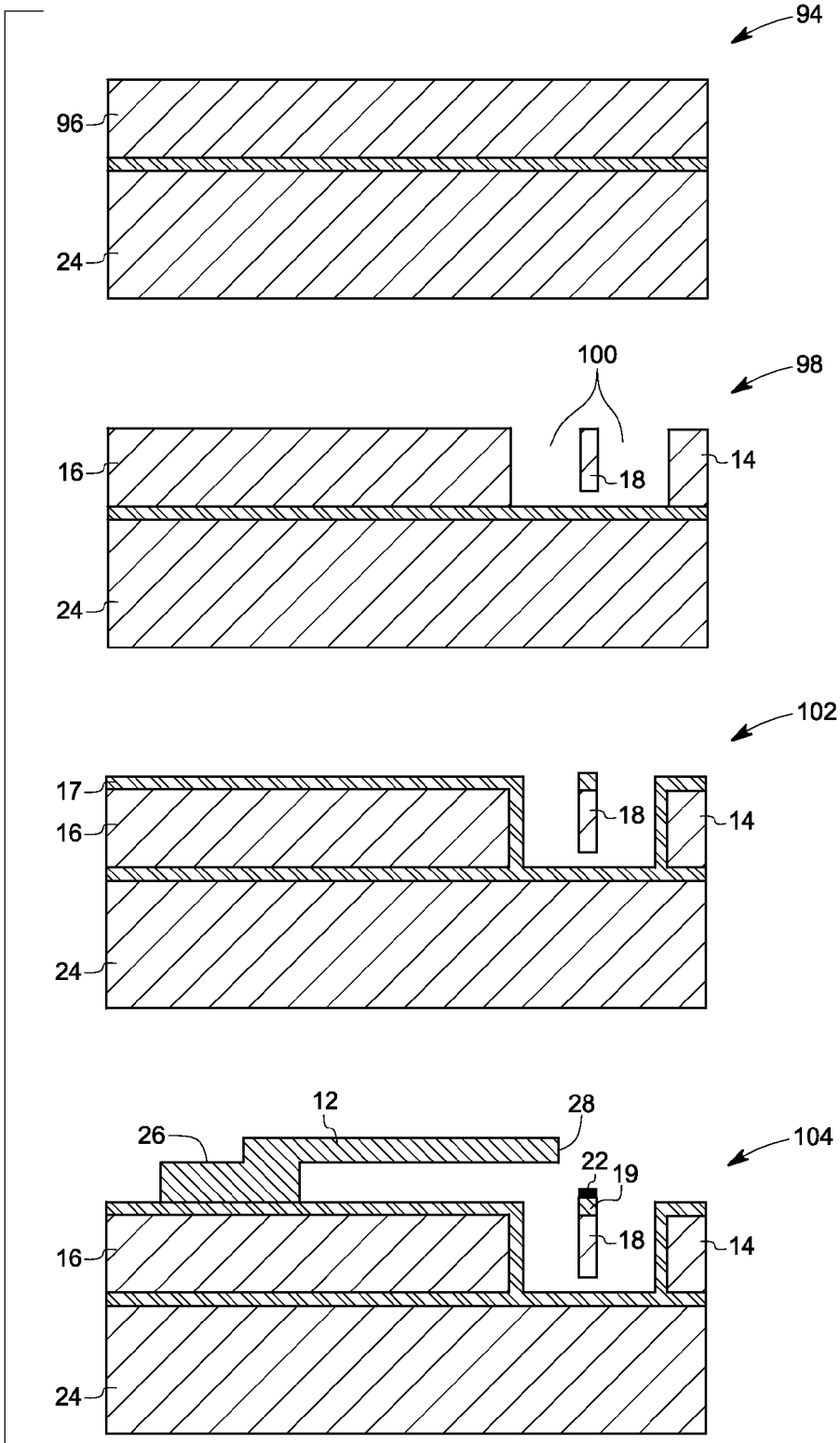
FIG. 7 illustrates exemplary stages of fabricating a MEMS switch in accordance with this invention.

FIG. 7 illustrates exemplary stages of fabricating a MEMS switch. In the initial stage (94), a base substrate 24 is provided. In one embodiment the base substrate 24 is a silicon substrate. In the second stage, an insulating layer 95 is formed on the base substrate 24. Furthermore, in the second stage, a top substrate 96 is formed on the insulating layer 95. In one embodiment, the top substrate is a conductive layer. In another embodiment, the top substrate is a semiconductive layer. In third stage 98, a second beam 18 is defined by partial removal of top substrate material 100 from the top substrate 96. In fourth stage 102, an insulating layer 17 is disposed on the top substrate. The insulating layer covers the top substrate and the second beam 18. In fifth stage 104, a cantilever beam 12 with a fixed end 26 is anchored on the top substrate 16. It may be noted that the cantilever beam 12 and the actuator 16 are electrically isolated via the insulation layer 17. A conducting layer 22 is formed on top of the second beam 18 to provide an electrical pathway between the cantilever beam 12 and the second beam 18 while in a "closed" position.

Figure 8:
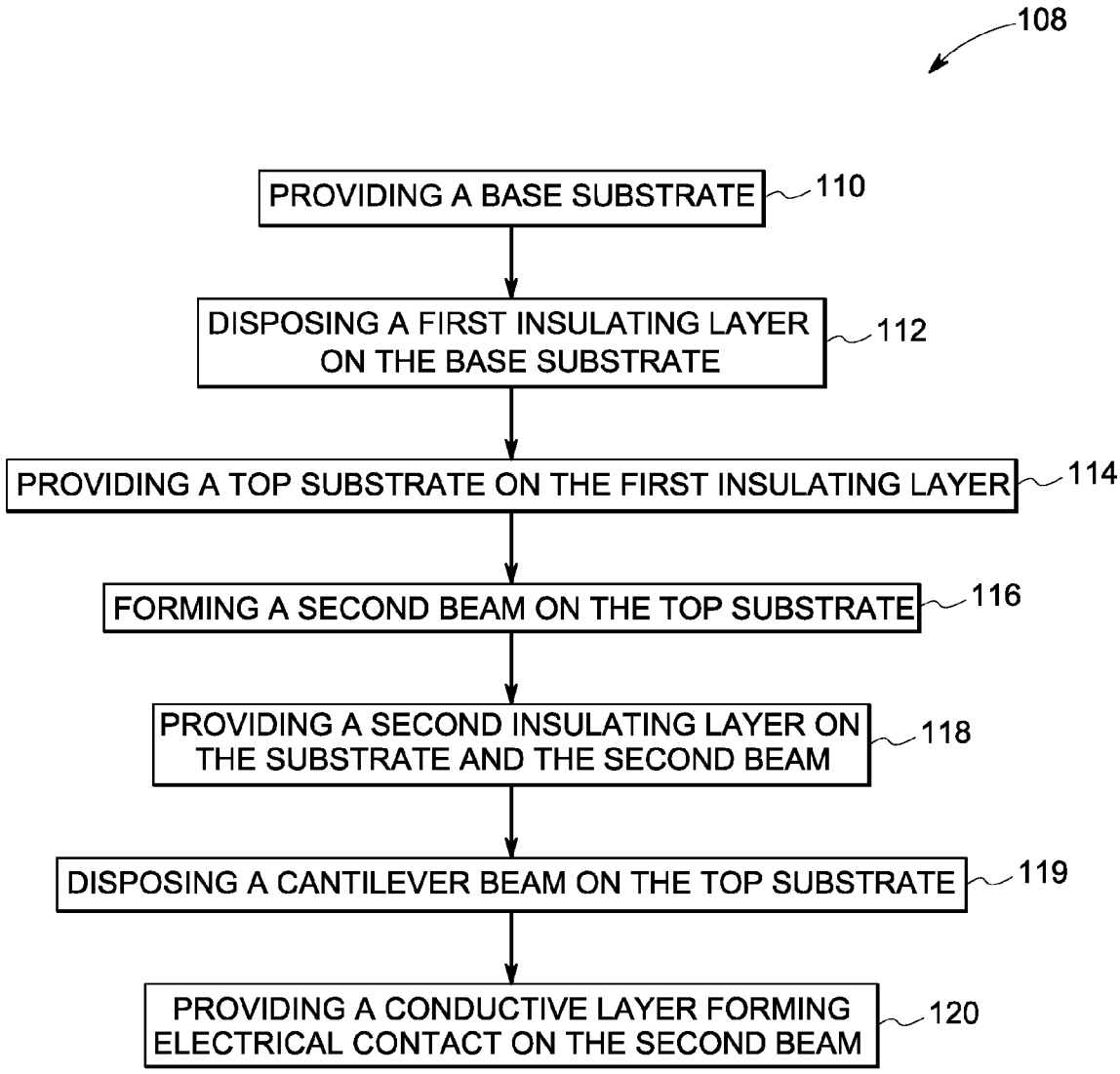
FIG. 8 is a flow chart of an exemplary method of making a MEMS switch in accordance with this invention.

FIG. 8 is a flow chart of an exemplary method of making the MEMS switch of FIG. 1. The method 108 includes providing a base substrate (step 110). A first insulating layer is disposed on the base substrate (step 112). A top substrate is disposed on the first insulating layer (step 114). A second beam 18 is defined on the top substrate as step 116. A second insulating layer is provided on the second beam and the top substrate (step 118). A cantilever beam is disposed on the top substrate at step 119. A conductive layer defining the electrical contact on the second beam is provided at step 120.

Advantageously, by such design, beams actuate in out-of-plane direction and in plane direction. This results in no overlap area between the two beams. The switch design decouples pull-in voltage from standoff voltage and eliminates overlap area. Such zero overlap often results in high standoff voltage with an adjustable pull-in voltage.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus comprising:

an electrical pathway comprising a first portion and a second portion, wherein the second portion is offset to a zero overlap position with respect to said first portion, the zero overlap position being relative to respective actuation directions of said first and second portions; and an actuator that moves both said first portion and said second portion to cause contact between said first and second portions.

2. The apparatus of claim 1, wherein the electrical pathway is configured to carry an electrical current.

3. The apparatus of claim 1, wherein the first portion is disposed around the actuator and configured to move upon actuation.

4. The apparatus of claim 1, wherein the second portion is disposed around the actuator and configured to abut with the first portion upon actuation.

5. The apparatus switch of claim 1, wherein the actuator is configured to generate an electrostatic force.

6. The apparatus of claim 5, wherein the electrostatic force moves the first portion and the second portion.

7. The apparatus of claim 1, wherein the first portion comprises a first mechanical characteristic and the second portion comprises a second mechanical characteristic.

8. The apparatus of claim 7, wherein the first mechanical characteristic comprises a first stiffness and the second mechanical characteristic comprises a second stiffness.

9. The apparatus of claim 1, wherein said first portion includes a cantilever beam; and said second portion includes a terminal.

10. The apparatus of claim 9, wherein the cantilever beam is disposed around the actuator.

11. The apparatus of claim 10, wherein the cantilever beam is affixed on a support post.

12. The apparatus of claim 1, wherein said first and second portions respectively include a first beam and a second beam, and wherein the first beam is suspended from an upper substrate.

13. The switch of claim 12, wherein the upper substrate is disposed on the actuator and the second beam.

14. The switch of claim 13, wherein the upper substrate is disposed with a pre-defined gap with respect to the actuator.

15. The switch of claim 12, wherein the first beam flexes out of plane with respect to the actuator.

16. The apparatus of claim 1, wherein said first portion includes a first beam, wherein the first beam comprises at least two free moving ends, and wherein said second portion includes a second beam disposed out of plane with respect to the first beam; further comprising a third beam disposed out of plane with respect to the first beam, wherein the third beam is offset to a zero overlap position with respect to the first beam; and wherein said actuator moves the third beam to make a contact and break the contact.

17. The apparatus of claim 16, wherein the contact comprises the first beam, the second beam, and the third beam.

18. The apparatus of claim 1, wherein said actuator moves both said first portion and said second portion along respectively different directions.

19. An apparatus comprising:

an electrical pathway comprising a first portion and a second portion, wherein the second portion is offset to a zero overlap position with respect to said first portion, the zero overlap position being relative to respective actuation directions of said first and second portions; and an actuator that moves both said first portion and said second portion to cause contact between said first and second portions upon actuation or de couple upon deactuation.

20. A method comprising:

providing a base substrate with a first electrically insulating surface;

providing a semiconductive top substrate on the first electrically insulating surface;

defining a second beam on the top substrate;

providing a second electrically insulating surface on the second beam and the top substrate;

forming an electrically conducting layer on the second beam;

disposing a cantilever beam on the top substrate providing a zero overlap area between the cantilever beam and the second beam, the zero overlap area being relative to respective actuation directions of said first and second portions;

configuring the top substrate as an actuator that moves both the cantilever beam and the second beam; and providing an electrical pathway between the cantilever beam and the second beam upon actuation.

* * * * *

UNITED STATES PATENT AND TRADEMARK OFFICE

CERTIFICATE OF CORRECTION

PATENT NO. : 8,093,971 B2
APPLICATION NO. : 12/340775
DATED : January 10, 2012
INVENTOR(S) : Wang et al.

It is certified that error appears in the above-identified patent and that said Letters Patent is hereby corrected as shown below:

On the Title page, item (75), under "Inventors", in Column 1, Lines 6-7, delete "IN (US)" and insert -- (IN) --, therefor.

In Column 6, Line 55, in Claim 5, delete "apparatus switch" and insert -- apparatus --, therefor.

In Column 7, Line 10, in Claim 13, delete "switch" and insert -- apparatus --, therefor.

In Column 7, Line 12, in Claim 14, delete "switch" and insert -- apparatus --, therefor.

In Column 7, Line 14, in Claim 15, delete "switch" and insert -- apparatus --, therefor.

In Column 8, Line 10, in Claim 19, delete "de couple" and insert -- de-couple --, therefor.

Signed and Sealed this
Fifth Day of June, 2012

David J. Kappos

David J. Kappos
*Director of the United States Patent and Trademark Office*